US012392107B2

(12) United States Patent
Hodel et al.

(10) Patent No.: US 12,392,107 B2
(45) Date of Patent: Aug. 19, 2025

(54) SYSTEMS AND METHODS FOR PLANNING AN EXCAVATOR DIG CYCLE

(71) Applicant: Caterpillar Inc., Peoria, IL (US)

(72) Inventors: Benjamin Hodel, Dunlap, IL (US); Benjamin Floyd, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 242 days.

(21) Appl. No.: 18/177,643

(22) Filed: Mar. 2, 2023

(65) Prior Publication Data

US 2024/0295095 A1 Sep. 5, 2024

(51) Int. Cl.

| | |
|---|---|
| ***E02F 3/43*** | (2006.01) |
| ***E02F 3/32*** | (2006.01) |
| ***E02F 9/20*** | (2006.01) |

(52) U.S. Cl.

CPC ..... *E02F 3/439* (2013.01); *E02F 3/32* (2013.01); *E02F 9/205* (2013.01)

(58) Field of Classification Search

CPC ... E02F 3/43; E02F 3/435; E02F 3/438; E02F 3/439; E02F 3/32; E02F 9/205; E02F 9/262

See application file for complete search history.

(56) References Cited

U.S. PATENT DOCUMENTS

| | | | | |
|---|---|---|---|---|
| 5,065,326 | A * | 11/1991 | Sahm | E02F 3/437 701/50 |
| 6,108,949 | A | 8/2000 | Singh et al. | |
| 6,363,632 | B1 * | 4/2002 | Stentz | E02F 9/24 701/50 |
| 7,532,967 | B2 | 5/2009 | Fujishima et al. | |
| 11,414,840 | B2 | 8/2022 | Takaoka | |
| 2021/0254312 | A1 | 8/2021 | Oi et al. | |

FOREIGN PATENT DOCUMENTS

| | | | |
|---|---|---|---|
| WO | 2022097428 | A1 | 5/2022 |
| WO | 2022145498 | A1 | 7/2022 |

* cited by examiner

*Primary Examiner* — Scott A Browne
*Assistant Examiner* — Jisun Choi

(57) ABSTRACT

A machine, including a bucket linkage that defines dig block constraints, including: a reach inside and outside limits; swing first and second limits; and a depth limit. Sensors can be positioned on the machine to count dig passes. One or more memory devices have instructions that when executed by one or more processors cause the processors to: generate an excavation plan, including: determining a number of elevations; determining a number of rings in each elevation; and determining a number of sectors in each ring; and direct the excavator to perform dig passes in order to sequentially excavate each sector, wherein the sectors in each elevation are excavated from the reach outside limit to the reach inside limit and from the swing first limit to the swing second limit; wherein the system moves to the next sector when a threshold number of dig passes is reached.

16 Claims, 7 Drawing Sheets

SYSTEMS AND METHODS FOR PLANNING AN EXCAVATOR DIG CYCLE

TECHNICAL FIELD

This patent application is directed to automated bulk excavation of material, and more specifically, to efficiently controlling automated excavators to remove material according to an optimized dig cycle.

BACKGROUND

An autonomous or automated excavator can be used to dig a block of material from the ground when performing mass or bulk excavation (of loose material). To be useful, such an excavator should dig autonomously with as little human intervention as possible. A productive (high tons per hour) and efficient (low fuel per hour) excavator can be of value to a customer. However, conventional methods for planning the movements of an excavator's linkage can result in wasted time, low bucket loads, and high fuel usage. While digging, material flows in unpredictable ways and can fall from the bucket back into previously excavated areas, so a dig planner must either prevent unwanted material movement, account for it or use an expensive perception system to sense the new terrain map. The ground may also resist the bucket in ways that could stop excavation from happening or from being executing according to the desired plan.

Efforts have been made to improve excavation planning. For example, U.S. Pat. No. 6,108,949 to Singh et al. (hereinafter "Singh"), describes a planning system for earthmoving operations such as digging that uses site geometry and divides terrain into a grid-like pattern of smaller excavation regions to determine boundaries and sequence of excavation. A refined planner then evaluates candidate excavations using a simulated model of a closed loop controller and by optimizing cost functions on criteria such as volume of material excavated, energy expended, and time, to determine the optimal location and orientation of a bucket of an excavator to begin excavating the region. The third level of the excavation planner is a control scheme wherein the selected excavation is executed by a closed loop controller that controls execution of a commanded excavation trajectory by monitoring forces exerted on a bucket, stick, and boom on an excavating machine. Singh, however, does not optimize the removal sequence of the smaller excavation regions.

Thus, there are still opportunities to improve on the efficiency controlling automated excavators to remove material according to an optimized dig cycle. The example systems and methods described herein are directed toward overcoming one or more of the deficiencies described above and/or other problems with the prior art.

SUMMARY

In some aspects, the techniques described herein relate to a machine, such as an excavator, including: a boom, a stick, and a bucket, each having a range of motion that together defines dig block constraints, including: a reach inside limit; a reach outside limit; a swing first limit; a swing second limit; and a depth limit; one or more sensors positioned on the machine to count dig passes; one or more processors; and one or more memory devices having stored thereon instructions that when executed by the one or more processors cause the one or more processors to: generate an excavation plan, including: determining a number of elevations; determining a number of rings in each elevation; and determining a number of sectors in each ring; and direct the machine to perform one or more dig passes in order to sequentially excavate each sector, wherein the sectors in each elevation are excavated from the reach outside limit to the reach inside limit and from the swing first limit to the swing second limit; wherein the system moves to the next sector when a threshold number of dig passes is reached.

In some aspects, the techniques described herein relate to a machine, wherein the number of rings is the reach outside limit minus the reach inside limit divided by a cut length corresponding to the amount of material that the bucket can carry.

In some aspects, the techniques described herein relate to a machine, wherein the number of sectors in a ring is the outer arc length between the swing first limit and the swing second limit divided by a width of the bucket.

In some aspects, the techniques described herein relate to a machine, wherein the sectors are excavated from the swing first limit to the swing second limit beginning with a sector furthest from a dump location.

In some aspects, the techniques described herein relate to a machine, wherein the one or more sensors include at least one joint angle sensor.

In some aspects, the techniques described herein relate to a machine, wherein the one or more sensors include at least one inertial measurement unit.

In some aspects, the techniques described herein relate to a machine, wherein the dig block constraints further include one or more avoidance zones.

In some aspects, the techniques described herein relate to a system for planning a machine dig cycle, including: one or more processors; and one or more memory devices having stored thereon instructions that when executed by the one or more processors cause the one or more processors to: generate an excavation plan, including: determining a number of elevations; determining a number of rings in each elevation; and determining a number of sectors in each ring; and direct a machine to perform one or more dig passes in order to sequentially excavate each sector, wherein the sectors in each elevation are excavated from a reach outside limit to a reach inside limit and from a swing first limit to a swing second limit; wherein the system directs the machine to move to the next sector when a threshold number of dig passes is reached.

In some aspects, the techniques described herein relate to a system, wherein the excavator includes a boom, a stick, and a bucket, each having a range of motion that together defines dig block constraints, including: the reach inside limit; the reach outside limit; the swing first limit; and the swing second limit.

In some aspects, the techniques described herein relate to a system, wherein the number of rings is the reach outside limit minus the reach inside limit divided by a cut length corresponding to the amount of material that the bucket can carry.

In some aspects, the techniques described herein relate to a system, wherein the number of sectors in a ring is the outer arc length between the swing first limit and the swing second limit divided by a width of the bucket.

In some aspects, the techniques described herein relate to a system, wherein the sectors are excavated from the swing first limit to the swing second limit beginning with a sector furthest from a dump location.

In some aspects, the techniques described herein relate to a system, wherein the dig block constraints further include one or more avoidance zones.

In some aspects, the techniques described herein relate to a method for planning a machine dig cycle, including: generating an excavation plan, including: determining a number of elevations; determining a number of rings in each elevation; and determining a number of sectors in each ring; directing a machine to perform one or more dig passes in order to sequentially excavate each sector, wherein the sectors in each elevation are excavated from a reach outside limit to a reach inside limit and from a swing first limit to a swing second limit; and directing the machine to move to the next sector when a threshold number of dig passes is reached.

In some aspects, the techniques described herein relate to a method, wherein the machine includes a boom, a stick, and a bucket, each having a range of motion that together defines dig block constraints, including: the reach inside limit; the reach outside limit; the swing first limit; and the swing second limit.

In some aspects, the techniques described herein relate to a method, wherein the number of rings is the reach outside limit minus the reach inside limit divided by a cut length corresponding to the amount of material that the bucket can carry.

In some aspects, the techniques described herein relate to a method, wherein the number of sectors in a ring is the outer arc length between the swing first limit and the swing second limit divided by a width of the bucket.

In some aspects, the techniques described herein relate to a method, wherein the sectors are excavated from the swing first limit to the swing second limit beginning with a sector furthest from a dump location.

In some aspects, the techniques described herein relate to a method, wherein the dig block constraints further include one or more avoidance zones.

BRIEF DESCRIPTION OF THE DRAWINGS

The systems and methods described herein may be better understood by referring to the following Detailed Description in conjunction with the accompanying drawings, in which like reference numerals indicate identical or functionally similar elements.

Figure 1:
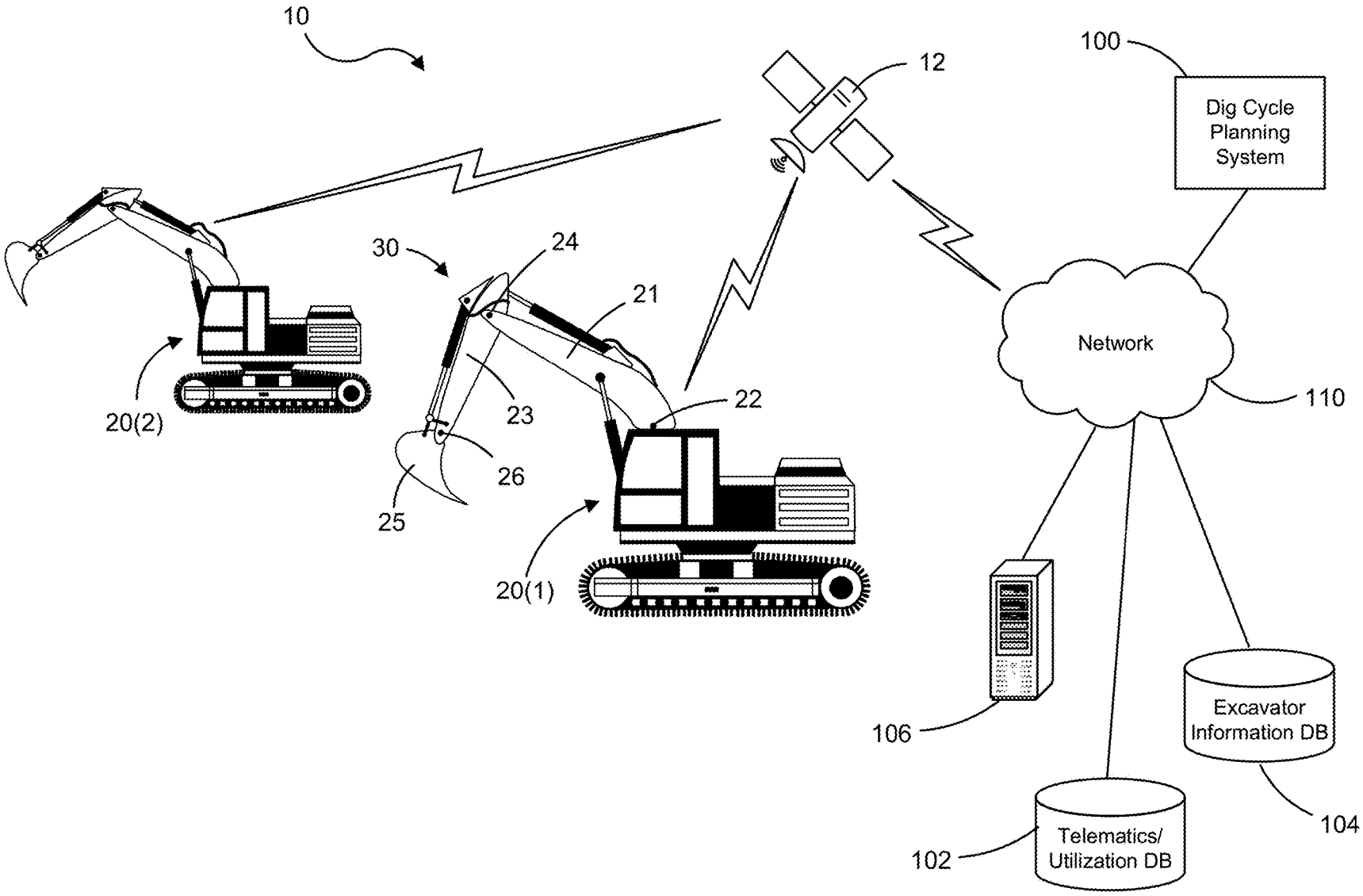
FIG. 1 is a diagram illustrating an overview of an environment in which some implementations can operate according to embodiments of the disclosed technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and alternatives falling within the scope of this disclosure.

DETAILED DESCRIPTION

Various examples of the systems and methods introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

The disclosed technology provides a dig cycle planner that can be a heuristic planner that determines a sequence of bucket passes to fully excavate a large volume of material from a single stationary track position. Disclosed herein are methods and systems for generating and executing an excavator dig cycle plan. The disclosed technology includes receiving excavator information that defines dig block constraints for the excavator. In some embodiments, the excavator information can include a reach inside limit, a reach outside limit, a swing first limit, a swing second limit, and a depth limit. The method includes generating an excavation plan based on the dig block constraints. In some embodiments, generating the excavation plan can include determining a number of elevations, determining a number of rings in each elevation, and determining a number of sectors in each ring. For a given machine size, there is a block reach range threshold below which rings are not needed. Above the threshold, the block can be decomposed into one or more rings to ensure that digging stays productive by "crowding" against undug material. The excavator is directed to perform one or more dig passes in order to excavate each sector according to the dig plan. The number of dig passes is monitored by the system to ensure that the dig plan is executed properly. The method directs the excavator to move to the next sector when a threshold number of dig passes is reached. In some embodiments, the system determines that the dig was effective and completed the sector from entry point to exit point, then it may move to the next sector after only one pass. If it does not, then excavation of the sector is attempted again. The threshold number is used to prevent an excessive or infinite number of attempts.

Dig cycle plan logic generally includes starting at a furthest reach of the bucket in order to crowd against un-dug areas of the dig block. The plan logic also includes starting furthest from the dump side in order to avoid spilling material back into the areas previously excavated. Sectors can be overlapped to avoid leaving thin "stranded" areas of material. Although the disclosed technology is shown and described with respect to hydraulic excavators, the technology applies to other machines performing excavation from a rotating chassis, such as hydraulic mining shovels, electric rope shovels, draglines, etc.

FIG. 1 illustrates an environment 10 in which some implementations of the dig cycle planning system 100 can operate according to embodiments of the disclosed technology. The system environment 10 can include multiple machines, such as excavators 20(1) and 20(2), a satellite 12, telematics/utilization database 102, an excavator linkage information database 104, a telematics processing system 106, and a network 110. The dig cycle planning system 100 can be connected to the telematics/utilization database 102, the excavator linkage information database 104, and the telematics processing system 106 via network 110. The telematics/utilization database 102 and the telematics processing system 106 can receive telematics data from the excavators 20(1) and 20(2) via satellite 12, cell, Wi-Fi, other radio, etc. The excavators 20 can include a linkage 30 including a boom 21, stick 23, and bucket 25. The telematics data can include sensor data from the excavators, such as from a cab swing sensor, a boom angle sensor 22, a stick angle sensor 24, and a bucket angle sensor 26, to name a few. In some embodiments, the sensors can include inertial measurement units (IMU).

In some embodiments, the telematics processing system 106 can use the sensor data from the linkage angle sensors 22, 24, and 26 to determine a number of dig passes that the excavator has performed. This information can be stored in the telematics/utilization database 102. In some embodiments, the dig cycle planning system 100 can receive the excavator linkage configuration information from database 104 in order to determine dig block constraints and generate an excavation plan according to the technology disclosed herein. In some embodiments, linkage sensors are not needed. The number of dig passes that the excavator has performed can be determined in software logic against an open- or closed-loop control system.

As described above, the dig cycle planning system 100 can operate across a network connected to different processing and storage components. However, in other embodiments the dig cycle planning system 100 can be located on the excavator itself along with various others of the processing and storage capabilities noted above. For example, the dig cycle planning system 100 can be configured to determine the number of dig passes performed by directly receiving and analyzing the linkage sensor data from the boom angle sensor 22, the stick angle sensor 24, and the bucket angle sensor 26.

Figure 2:
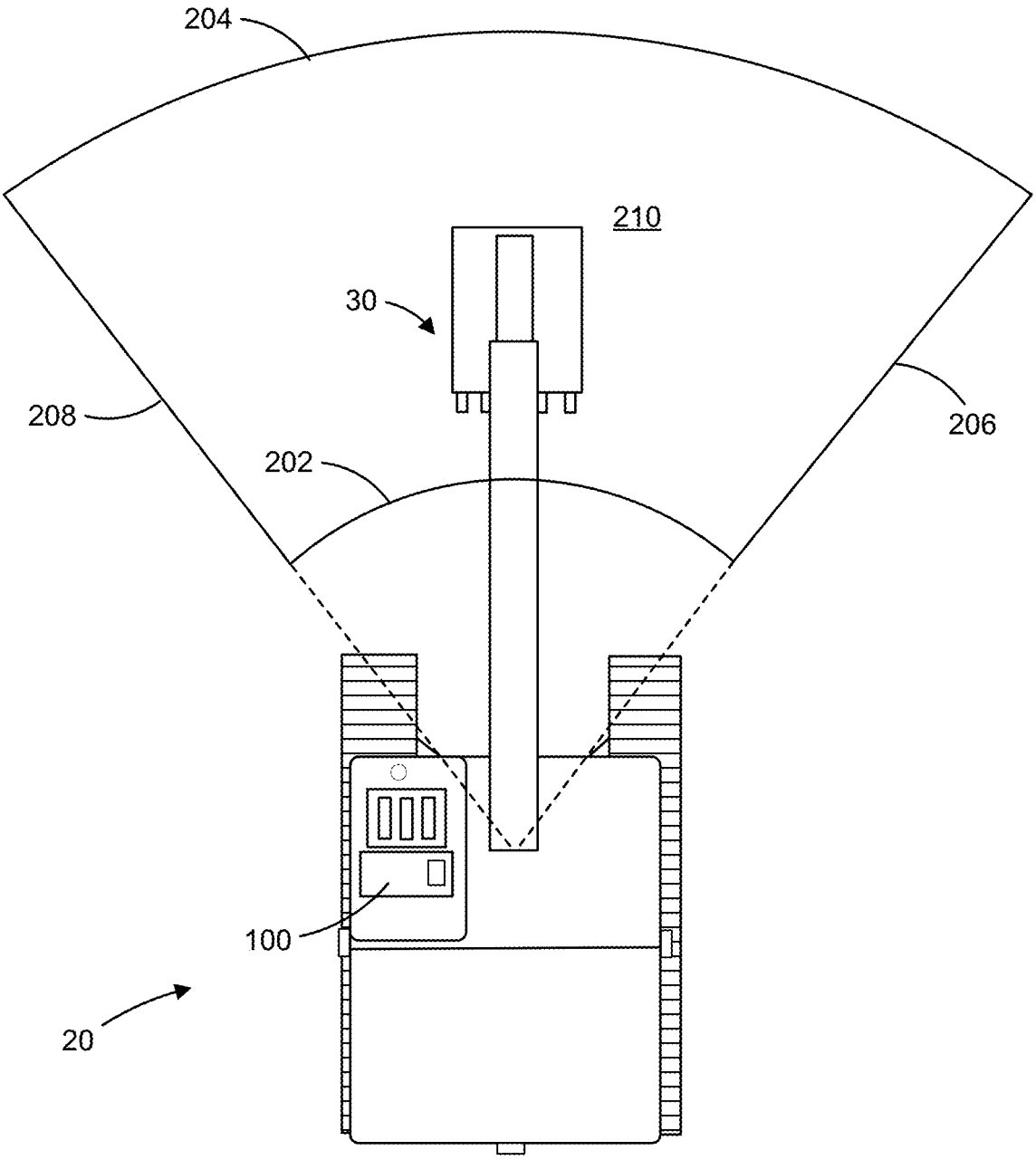
FIG. 2 is a top plan view schematically illustrating an excavator having a bucket linkage defining dig block constraints according to some embodiments of the disclosed technology.

FIG. 2 is a diagram illustrating the dig block constraints for the excavator 20. The dig block constraints are defined by the range of motion of the linkage 30 including the boom, stick, and bucket. The dig block constraints include a reach inside limit 202, a reach outside limit 204, a swing first limit (e.g., right) 206, a swing second limit (e.g., left) 208, and a depth limit 210. The above mentioned limits can be defined in terms of angle and/or arc length for example.

Figure 3A:
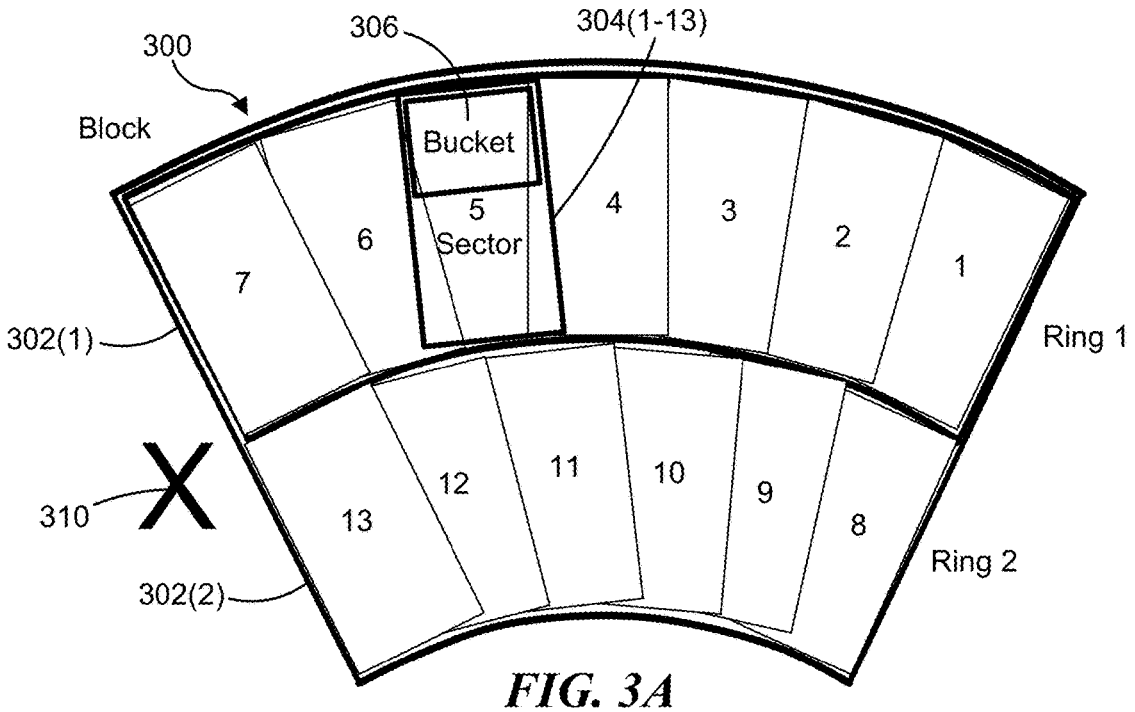
FIG. 3A is a dig cycle plan diagram having a single dump location according to some embodiments of the disclosed technology.
Figure 3B:
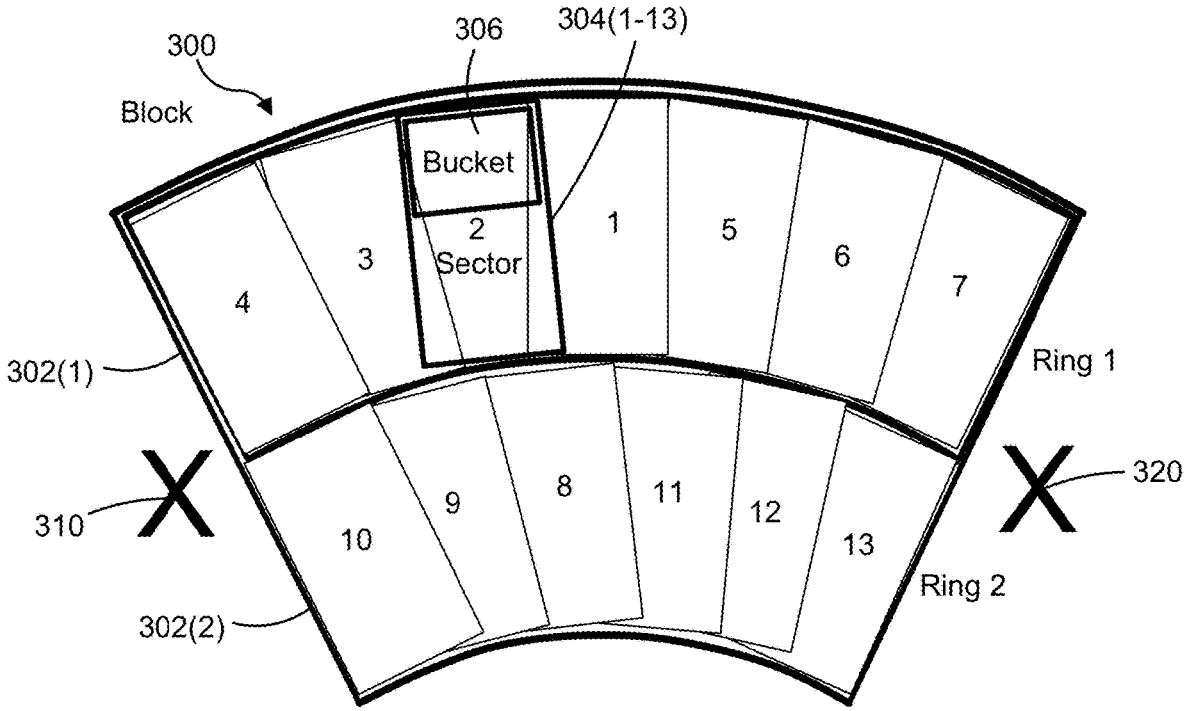
FIG. 3B is a dig cycle plan diagram having two dump locations according to some embodiments of the disclosed technology.

FIGS. 3A and 3B illustrate dig cycle plan diagrams having a single dump location and two dump locations, respectively. Each diagram includes a block 300 that comprises an arc-shaped volume that the excavator can remove from one position. The block 300 can also be referred to as an annular sector or circular ring sector. The block 300 includes one or more elevations (e.g., layers) defined by the depth limit 210 (FIG. 2). In some embodiments, the number of elevations can be determined by dividing the depth limit by an effective dig pass cutting depth. The effective dig pass cutting depth can be predetermined experimentally, or be a parametric function of soil type, bucket cutting geometry and volume, etc. Each elevation is divided into one or more rings 302 that are constrained by the optimal cut length. The optimal cut length is the length of cut that excavates an amount of material that fills the bucket of the excavator. In other words, the optimal cut length is a cut length corresponding to the amount of material that the bucket can carry. The stroke length necessary to provide a full bucket can be estimated, or a conversion factor (e.g., empirically determined) can be used. In some embodiments, the number of rings 302 is calculated as the reach outside limit 204 minus the reach inside limit 202 (see FIG. 2) divided by the optimal cut length. If reach range is less than the optimal cut length, then one ring is sufficient. If the result of the ring calculation is not an integer number, e.g., 1.2, then it can be rounded up to the nearest integer, i.e., 2.

Each ring 302 is divided into multiple sectors 304 which are defined by the width 306 of the excavator's bucket. Accordingly, in some embodiments, the number of sectors 304 in a ring 302 can be calculated as the rings outer arc length between the swing first limit 206 and the swing second limit 208 (see FIG. 2) divided by a width 306 of the bucket. In some embodiments, the number of sectors 304 in a ring 302 can be calculated as the rings outer arc length between the swing first limit 206 and the swing second limit 208 divided by an arc length corresponding to the width 306 of the bucket. If the result of the sector calculation is not an integer number, then it can be rounded up to the nearest integer.

In some embodiments, the dig plan can be smaller footprint than the full range of motion if constrained to optimize break-out force or fuel efficiency. Alternatively, it could be constrained so as to not include an avoidance zone or to stay within the overall perimeter of a foundation design, etc.

In general, the dig cycle planning system 100 directs the excavator to dig the block 300 in elevations from top to bottom and dig each elevation through the sequence of rings 302. The outer ring(s) are excavated before the inner ring(s). For example, ring 302(1) is excavated prior to ring 302(2). Each ring 302 is excavated through a sequence of the sectors 304. The sectors overlap to avoid thin strands of material being left behind. Each sector 304 is excavated through a sequence of dig passes to excavate the sector. When a sector is cleared, the system directs the excavator to proceed to the next sector in the sequence. When a block is excavated, the HEX tracks to a new location to clear another block.

The sector sequence is determined, in part, by the number and location of the dump locations. Sectors furthest from the dump location(s) are excavated before sectors closer to the dump location. If dumping on both sides, one half of the sectors in a ring are excavated before the other half. Thus, the excavator starts at its furthest reach in order to crowd material against un-dug areas of the block. This sequence logic also avoids spilling material back into the pit.

In FIG. 3A, the dig block 300 has one dump location 310 on the left side of the block. Accordingly, the sequence of sectors to be removed starts furthest away from the dump location 310 at sector 304(1) and sequences toward the dump location 310 until the last sector 304(7) in ring 302(1)

is excavated. In other words, the sectors 304 can be excavated from the first swing limit 206 to the second swing limit 208 (FIG. 2). When the dump location 310 is on the right side of the dig block 300, the sectors 304 can be excavated from the second swing limit 208 to the first swing limit 206. Similarly, with the sectors 304(8)-304(13) in ring 302(2). In the diagram the sectors are numbered in the order in which they should be excavated.

In FIG. 3B, the dig block 300 has two dump locations, sometimes referred to as double-sided loading. Location 310 is located on the left side of the block 300 and the second location 320 is located on the right side of the block 300. Accordingly, the sequence of sectors to be removed starts from the middle and moves toward the first dump location 310 at sector 304(1) and sequences toward the dump location 310 until the left most sector 304(4) in ring 302(1) is excavated. Next, sectors 304(5)-304(7) are excavated and dumped at location 320. Similarly, with the sectors 304(8)-304(13). In some embodiments, a counter is incremented as each dig pass is completed and reset for each new sector. If the sector has been excavated or if the counter exceeds the count limit, the system directs the excavator to proceed to the next sector. This avoids cases where the bucket cannot physically clear a sector.

Figure 4:
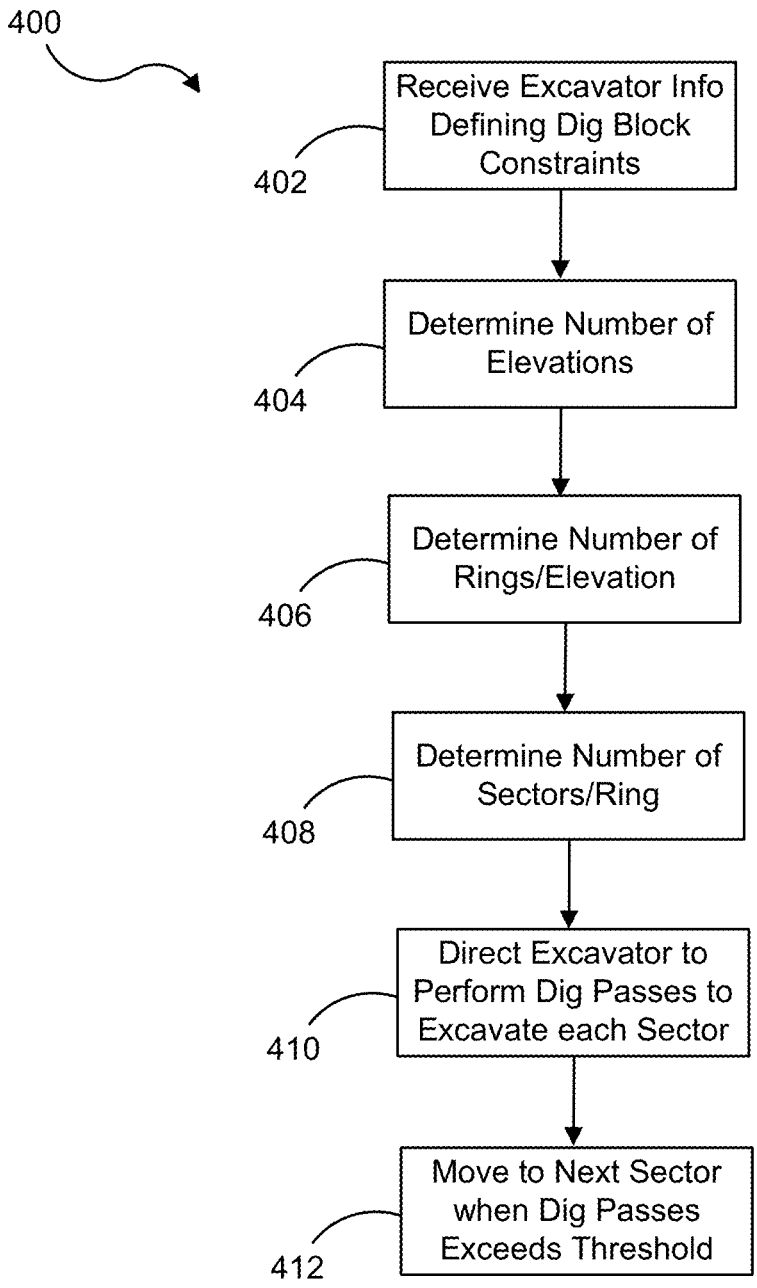
FIG. 4 is a flow diagram showing a method for planning an excavator dig cycle according to some embodiments of the disclosed technology.

FIG. 4 is a flow diagram showing a method 400 for planning an excavator dig cycle according to some embodiments of the disclosed technology. The method 400 can include receiving excavator information at step 402 that defines dig block constraints for the excavator. In some embodiments, the excavator information can include a reach inside limit, a reach outside limit, a swing first limit, a swing second limit, and a depth limit. The method includes generating an excavation plan based on the dig block constraints. In some embodiments, generating the excavation plan can include determining a number of elevations at step 404, determining a number of rings in each elevation at step 406, and determining a number of sectors in each ring at step 408. At step 410, the method directs the excavator to perform one or more dig passes in order to excavate each sector according to the dig plan. At step 412, the method directs the excavator to move to the next sector when a threshold number of dig passes is reached. In some embodiments, the sectors in each elevation are excavated from a reach outside limit to a reach inside limit and from a swing first limit to a swing second limit. In some embodiments, the number of rings can be the reach outside limit minus the reach inside limit divided by a cut length corresponding to the amount of material that the bucket can carry. In some embodiments, the number of sectors in a ring can be the outer arc length between the swing first limit and the swing second limit divided by a width of the bucket. In some embodiments, the sectors are excavated from the swing first limit to the swing second limit beginning with a sector furthest from a dump location. In some embodiments, the excavator can be configured as an autonomous vehicle which receives commands from the dig cycle planning system to sequentially remove material from each sector until a block is excavated. Once a block is excavated the excavator can move to a new location to excavate subsequent blocks.

Suitable System

The techniques disclosed here can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to cause a computer, a microprocessor, processor, and/or microcontroller (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

Figure 5:
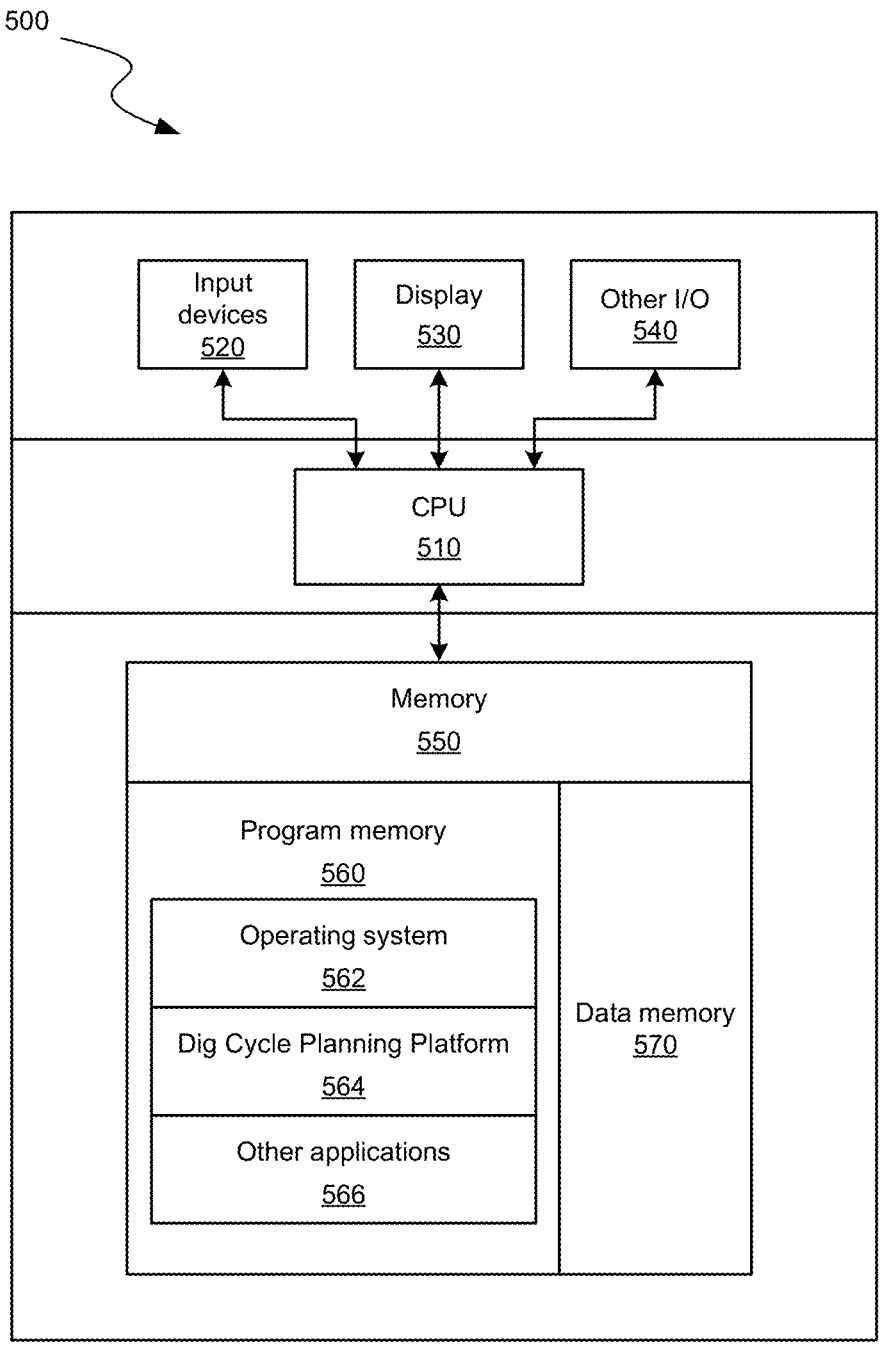
FIG. 5 is a block diagram illustrating an overview of devices on which some implementations can operate.

Several implementations are discussed below in more detail in reference to the figures. FIG. 5 is a block diagram illustrating an overview of devices on which some implementations of the disclosed technology can operate. The devices can comprise hardware components of a device 500 that automatically determines a dig cycle plan, for example. Device 500 can include one or more input devices 520 that provide input to the CPU (processor) 510, notifying it of actions. The actions are typically mediated by a hardware controller that interprets the signals received from the input device and communicates the information to the CPU 510 using a communication protocol. Input devices 520 include, for example, a mouse, a keyboard, a touchscreen, an infrared sensor, a touchpad, a wearable input device, a camera- or image-based input device, a microphone, or other user input devices.

CPU 510 can be a single processing unit or multiple processing units in a device or distributed across multiple devices. CPU 510 can be coupled to other hardware devices, for example, with the use of a bus, such as a PCI bus or SCSI bus. The CPU 510 can communicate with a hardware controller for devices, such as for a display 530. Display 530 can be used to display text and graphics. In some examples, display 530 provides graphical and textual visual feedback to a user. In some implementations, display 530 includes the input device as part of the display, such as when the input device is a touchscreen or is equipped with an eye direction monitoring system. In some implementations, the display is separate from the input device. Examples of display devices are: an LCD display screen; an LED display screen; a projected, holographic, or augmented reality display (such as a heads-up display device or a head-mounted device); and so on. Other I/O devices 540 can also be coupled to the processor, such as a network card, video card, audio card, USB, FireWire or other external device, sensor, camera, printer, speakers, CD-ROM drive, DVD drive, disk drive, or Blu-Ray device.

In some implementations, the device 500 also includes a communication device capable of communicating wirelessly or wire-based with a network node. The communication device can communicate with another device or a server through a network using, for example, TCP/IP protocols. Device 500 can utilize the communication device to distribute operations across multiple network devices.

The CPU 510 can have access to a memory 550. A memory includes one or more of various hardware devices for volatile and non-volatile storage, and can include both read-only and writable memory. For example, a memory can comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory is not a propagating signal divorced from underlying hardware; a memory is thus non-transitory. Memory 550 can include program memory 560 that stores programs and software, such as an operating system 562, Dig Cycle Planning Platform 564, and other application programs 566. Memory 550 can also include data memory 570 that can include database information, etc., which can be provided to the program memory 560 or any element of the device 500.

Some implementations can be operational with numerous other general purpose or special purpose computing system environments or configurations. Examples of well-known computing systems, environments, and/or configurations that may be suitable for use with the technology include, but are not limited to, personal computers, server computers, handheld or laptop devices, cellular telephones, mobile phones, wearable electronics, gaming consoles, tablet devices, multiprocessor systems, microprocessor-based systems, set-top boxes, programmable consumer electronics, network PCs, minicomputers, mainframe computers, distributed computing environments that include any of the above systems or devices, or the like.

Figure 6:
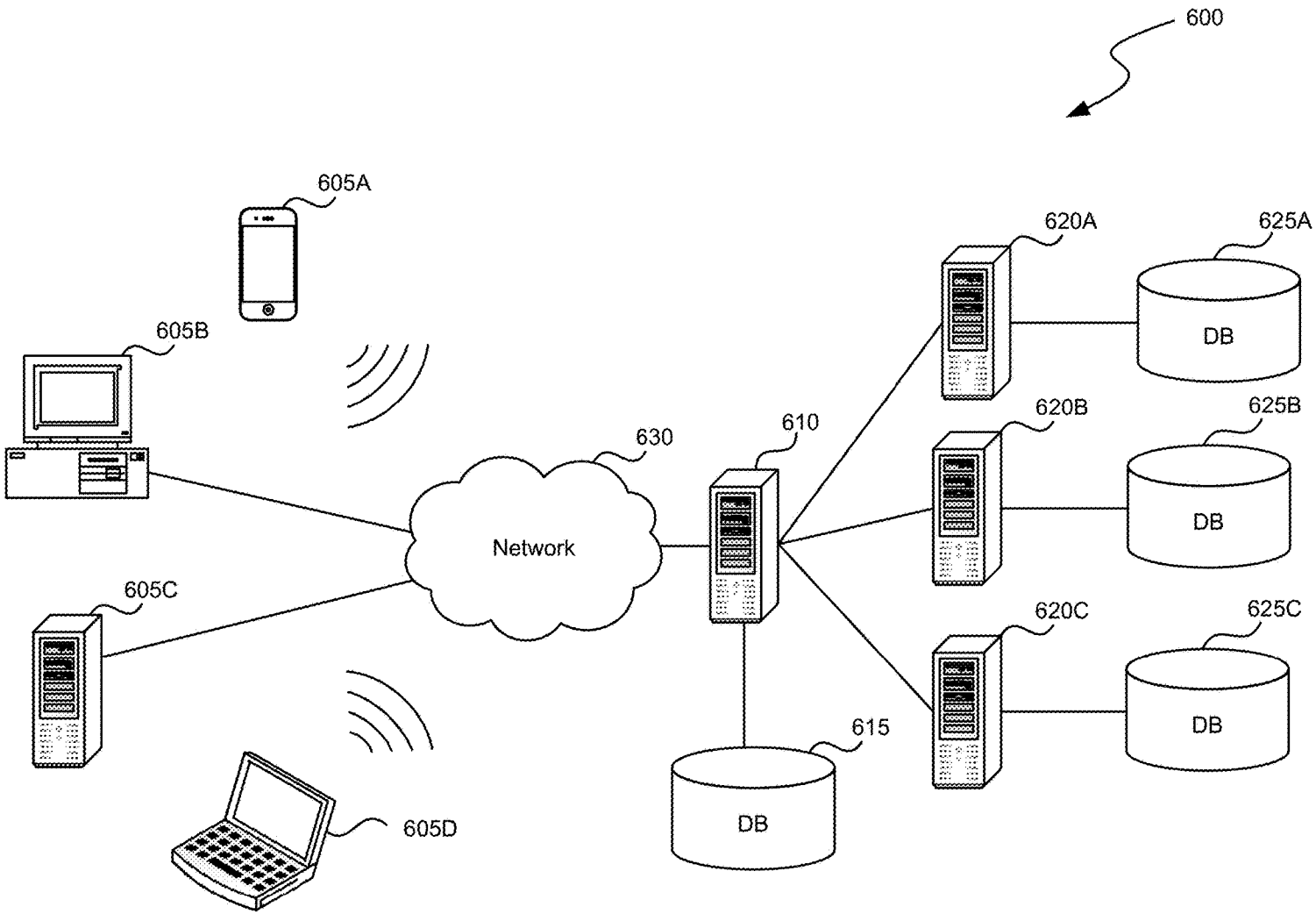
FIG. 6 is a block diagram illustrating an overview of an environment in which some implementations can operate.

FIG. 6 is a block diagram illustrating an overview of an environment 600 in which some implementations of the disclosed technology can operate. Environment 600 can include one or more client computing devices 605A-D, examples of which can include device 500. Client computing devices 605 can operate in a networked environment using logical connections through network 630 to one or more remote computers, such as a server computing device 610.

In some implementations, server computing device 610 can be an edge server that receives client requests and coordinates fulfillment of those requests through other servers, such as servers 620A-C. Server computing devices 610 and 620 can comprise computing systems, such as device 500. Though each server computing device 610 and 620 is displayed logically as a single server, server computing devices can each be a distributed computing environment encompassing multiple computing devices located at the same or at geographically disparate physical locations. In some implementations, each server computing device 620 corresponds to a group of servers.

Client computing devices 605 and server computing devices 610 and 620 can each act as a server or client to other server/client devices. Server 610 can connect to a database 615. Servers 620A-C can each connect to a corresponding database 625A-C. As discussed above, each server 620 can correspond to a group of servers, and each of these servers can share a database or can have their own database. Databases 615 and 625 can warehouse (e.g., store) information. Though databases 615 and 625 are displayed logically as single units, databases 615 and 625 can each be a distributed computing environment encompassing multiple computing devices, can be located within their corresponding server, or can be located at the same or at geographically disparate physical locations.

Network 630 can be a local area network (LAN) or a wide area network (WAN), but can also be other wired or wireless networks. Network 630 may be the Internet or some other public or private network. Client computing devices 605 can be connected to network 630 through a network interface, such as by wired or wireless communication. While the connections between server 610 and servers 620 are shown as separate connections, these connections can be any kind of local, wide area, wired, or wireless network, including network 630 or a separate public or private network.

Figure 7:
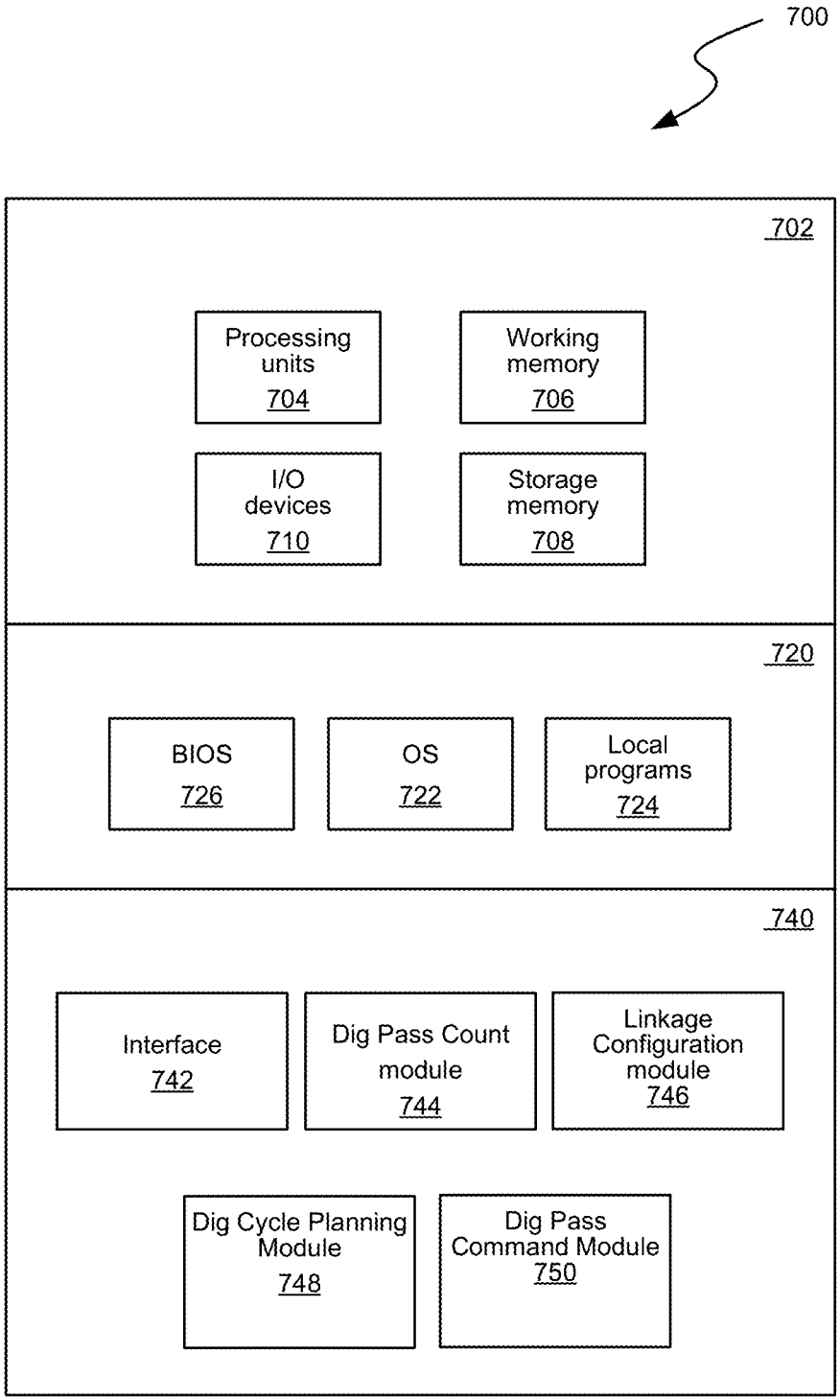
FIG. 7 is a block diagram illustrating components which, in some implementations, can be used in a system employing the disclosed technology.

FIG. 7 is a block diagram illustrating components 700 which, in some implementations, can be used in a system employing the disclosed technology. The components 700 include hardware 702, general software 720, and specialized components 740. As discussed above, a system implementing the disclosed technology can use various hardware, including processing units 704 (e.g., CPUs, GPUs, APUs, etc.), working memory 706, storage memory 708, and input and output devices 710. Components 700 can be implemented in a client computing device such as client computing devices 605 or on a server computing device, such as server computing device 610 or 620.

General software 720 can include various applications, including an operating system 722, local programs 724, and a basic input output system (BIOS) 726. Specialized components 740 can be subcomponents of a general software application 720, such as local programs 724. Specialized components 740 can include a dig pass counting module 744, a linkage configuration module 746, a dig cycle planning module 748, a dig pass command module 750, and components that can be used for transferring data and controlling the specialized components, such as interface 742. In some implementations, components 700 can be in a computing system that is distributed across multiple computing devices or can be an interface to a server-based application executing one or more of specialized components 740.

Those skilled in the art will appreciate that the components illustrated in FIGS. 5-7 described above, and in each of the flow diagrams discussed above, may be altered in a variety of ways. For example, the order of the logic may be rearranged, sub steps may be performed in parallel, illustrated logic may be omitted, other logic may be included, etc. In some implementations, one or more of the components described above can execute one or more of the processes described herein.

Industrial Applicability

In some embodiments, a dig cycle planning system can include a dig pass counting module 744, a linkage configuration module 746, a dig cycle planning module 748, and a dig pass command module 750 (FIG. 7). In operation, the linkage configuration module 746 receives information pertaining to the boom, stick, and bucket of an excavator. In some embodiments, module 746 can receive a corresponding reach inside limit, reach outside limit, swing first limit, swing second limit, and depth limit. In other embodiments, the module 746 calculates these limits based on the received linkage information, such as lengths and geometries of the boom, stick, and bucket, for example. The dig cycle planning module 748 generates an excavation plan, including: determining a number of elevations; determining a number of rings in each elevation; and determining a number of sectors in each ring. The dig pass command module 750 directs the excavator to perform one or more dig passes in order to sequentially excavate each sector, wherein the sectors in each elevation are excavated from the reach outside limit to the reach inside limit and from the swing first limit to the swing second limit. The dig pass counting module 744 counts the number of dig passes and directs the system to move to the next sector when a threshold number of dig passes is reached.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A machine, comprising:

a boom, a stick, and a bucket, each having a range of motion that together defines dig block constraints, including:
- a reach inside limit;
- a reach outside limit;
- a swing first limit;
- a swing second limit; and
- a depth limit;

one or more sensors positioned on the machine to count dig passes;

one or more processors; and one or more memory devices having stored thereon instructions that when executed by the one or more processors cause the one or more processors to:

generate an excavation plan, including:
- determining a number of elevations;
- determining a number of rings in each elevation; and
- determining a number of sectors in each ring; and direct the machine to perform one or more dig passes in order to sequentially excavate each sector, wherein the sectors in each elevation are excavated from the reach outside limit to the reach inside limit and, beginning with a sector furthest from a dump location, from the swing first limit to the swing second limit;

wherein the instructions cause the machine to move to a next sector when a threshold number of dig passes is reached.

2. The machine of claim 1, wherein the number of rings is the reach outside limit minus the reach inside limit divided by a cut length corresponding to an amount of material that the bucket can carry.

3. The machine of claim 1, wherein the number of sectors in a ring is an outer arc length between the swing first limit and the swing second limit divided by a width of the bucket.

4. The machine of claim 1, wherein the one or more sensors comprise at least one joint angle sensor.

5. The machine of claim 1, wherein the one or more sensors comprise at least one inertial measurement unit.

6. The machine of claim 1, wherein the dig block constraints further include one or more avoidance zones.

7. A system for planning a machine dig cycle, comprising:

one or more processors; and one or more memory devices having stored thereon instructions that when executed by the one or more processors cause the one or more processors to:

generate an excavation plan, including:
- determining a number of elevations;
- determining a number of rings in each elevation; and
- determining a number of sectors in each ring; and direct a machine to perform one or more dig passes in order to sequentially excavate each sector, wherein the sectors in each elevation are excavated from a reach outside limit to a reach inside limit and, beginning with a sector furthest from a dump location, from a swing first limit to a swing second limit;

wherein the system directs the machine to move to a next sector when a threshold number of dig passes is reached.

8. The system of claim 7, wherein the machine includes a boom, a stick, and a bucket, each having a range of motion that together defines dig block constraints, including:
- the reach inside limit;
- the reach outside limit;
- the swing first limit; and
- the swing second limit.

9. The system of claim 8, wherein the dig block constraints further include one or more avoidance zones.

10. The system of claim 7, wherein the number of rings is the reach outside limit minus the reach inside limit divided by a cut length corresponding to an amount of material that a bucket of the machine can carry.

11. The system of claim 7, wherein the number of sectors in a ring is an outer arc length between the swing first limit and the swing second limit divided by a width of a bucket of the machine.

12. A method for planning a machine dig cycle, comprising:

generating an excavation plan, including:
- determining a number of elevations;
- determining a number of rings in each elevation; and
- determining a number of sectors in each ring;

directing a machine to perform one or more dig passes in order to sequentially excavate each sector, wherein the sectors in each elevation are excavated from a reach outside limit to a reach inside limit and, beginning with a sector furthest from a dump location, from a swing first limit to a swing second limit; and directing the machine to move to a next sector when a threshold number of dig passes is reached.

13. The method of claim 12, wherein the machine includes a boom, a stick, and a bucket, each having a range of motion that together defines dig block constraints, including:
- the reach inside limit;
- the reach outside limit;
- the swing first limit; and
- the swing second limit.

14. The method of claim 13, wherein the dig block constraints further include one or more avoidance zones.

15. The method of claim 13, wherein the number of rings is the reach outside limit minus the reach inside limit divided by a cut length corresponding to an amount of material that the bucket can carry.

16. The method of claim 13, wherein the number of sectors in a ring is an outer arc length between the swing first limit and the swing second limit divided by a width of the bucket.

* * * * *